US007150342B2

(12) United States Patent
Adifon et al.

(10) Patent No.: US 7,150,342 B2
(45) Date of Patent: Dec. 19, 2006

(54) ELEVATOR STRUCTURE MOUNTING SYSTEM HAVING HORIZONTAL MEMBER FOR REDUCING BUILDING LOADS AT TOP OF HOISTWAY

(75) Inventors: Leandre Adifon, Farmington, CT (US); Richard N. Fargo, Plainville, CT (US); Thomas E. Landry, Collinsville, CT (US); James A. Rivera, Bristol, CT (US); Bruce St. Pierre, Bristol, CT (US); Bruce P. Swaybill, Farmington, CT (US)

(73) Assignee: Otis Elevator Company, Farmington, CT (US)

( * ) Notice: Subject to any disclaimer, the term of this patent is extended or adjusted under 35 U.S.C. 154(b) by 592 days.

(21) Appl. No.: 09/497,359

(22) Filed: Feb. 3, 2000

(65) Prior Publication Data

US 2002/0148688 A1 Oct. 17, 2002

(51) Int. Cl.
*B66B 7/08* (2006.01)

(52) U.S. Cl. ..... 187/411; 187/404; 187/406

(58) Field of Classification Search ..... 187/213, 187/264, 265, 266, 404, 406, 407, 411, 412, 187/414

See application file for complete search history.

(56) References Cited

U.S. PATENT DOCUMENTS 3,101,130 A * 8/1963 Bianca ..... 187/266 X
3,395,777 A * 8/1968 Rodosta ..... 187/213
3,759,349 A * 9/1973 Sieffert ..... 187/406 X
5,009,288 A 4/1991 Nakai et al.
5,033,587 A 7/1991 Nakai et al.
5,299,662 A 4/1994 Reddy et al.
5,490,578 A 2/1996 Aulanko et al. ..... 187/254
5,833,031 A * 11/1998 Liebetrau et al. ..... 187/404 X
5,878,847 A * 3/1999 Mustalahti et al. ..... 187/266 X
5,899,300 A * 5/1999 Miller et al. ..... 187/404 X
5,899,301 A * 5/1999 Aulanko et al. ..... 187/266
6,021,873 A * 2/2000 Aulanko et al. ..... 187/411
6,193,017 B1 * 2/2001 Koster ..... 187/266 X
6,234,276 B1 * 5/2001 Wagatsuma et al. ..... 187/411

FOREIGN PATENT DOCUMENTS

JP 7-300285 A * 11/1995
WO WO99/48789 A1 * 9/1999

* cited by examiner

*Primary Examiner*—Eileen D. Lillis

(57) ABSTRACT

A structural system for elevator assemblies includes a horizontal compression member positioned near the top of the elevator hoistway for reacting to inwardly directed tension loads and moment forces applied to the hoistway wall and connection components resulting from the elevator vertical load. The horizontal compression member includes a rigid member positioned in a compression state between mounting structures for elevator ropes and elevator machine components such that the compression member reacts and counters inwardly directed horizontal forces and resultant moment forces caused by a centralized, downward vertical load.

20 Claims, 2 Drawing Sheets

ELEVATOR STRUCTURE MOUNTING SYSTEM HAVING HORIZONTAL MEMBER FOR REDUCING BUILDING LOADS AT TOP OF HOISTWAY

TECHNICAL FIELD

The present invention relates to elevators and, more specifically, to an elevator system structural support for providing reaction forces to bolt tension and moment forces associated with elevator components attached to a building structure.

BACKGROUND OF THE INVENTION

Traditional elevator systems have machine rooms located overhead in the elevator hoistway or shaft for housing the lifting motor, drive system and various other components. The terminal ends of elevator ropes that attach overhead are typically located in the machine room. Typical machine rooms provide ample space for elevator rope termination hitches having configurations capable of supporting substantial vertical loads.

Elevator systems of the type having no machine room are limited in overhead space. Thus, machine and rope terminations located at the top of the hoistway must be designed to fit within a relatively confined area while providing support for substantial vertical loads. Such vertical loads are supported by the elevator rails or similar structures. The resultant vertical load is concentrated toward the inside of the hoistway, generally coincident with the centers of mass of the elevator car and counterweight. The resultant vertical load, therefore, causes a moment force applied to the support structures. The moment is typically reacted through tensile loading of brackets, and bolts attaching the brackets to the hoistway walls, near the top of the hoistway. Such tensile loading requires significant hoistway wall strength, thereby increasing building cost.

OBJECTS AND SUMMARY OF THE INVENTION

It is an object of the invention, therefore, to provide an elevator system having structural means to alleviate or eliminate moment loads or tensile loads resulting from the same in elevator structure connections to building structures.

It is a further object of the present invention to provide an elevator system that reduces building cost requirements by minimizing moment and tensile loads resulting from elevator structure connections.

These objects and others are achieved by the present invention elevator system.

The present invention is directed to a structural system for elevator assemblies including a horizontal compression member positioned near the top of the hoistway for reacting to inwardly directed tension loads and moment forces applied to the hoistway wall and connection components resulting from the elevator vertical load. The horizontal compression member comprises a member positioned in a compression state between mounting structures for elevator ropes and elevator machine components such that the compression member reacts and counters inwardly directed horizontal forces and resultant moment forces caused by a centralized, downward vertical load.

DESCRIPTION OF THE PREFERRED EMBODIMENT

Figure 1:
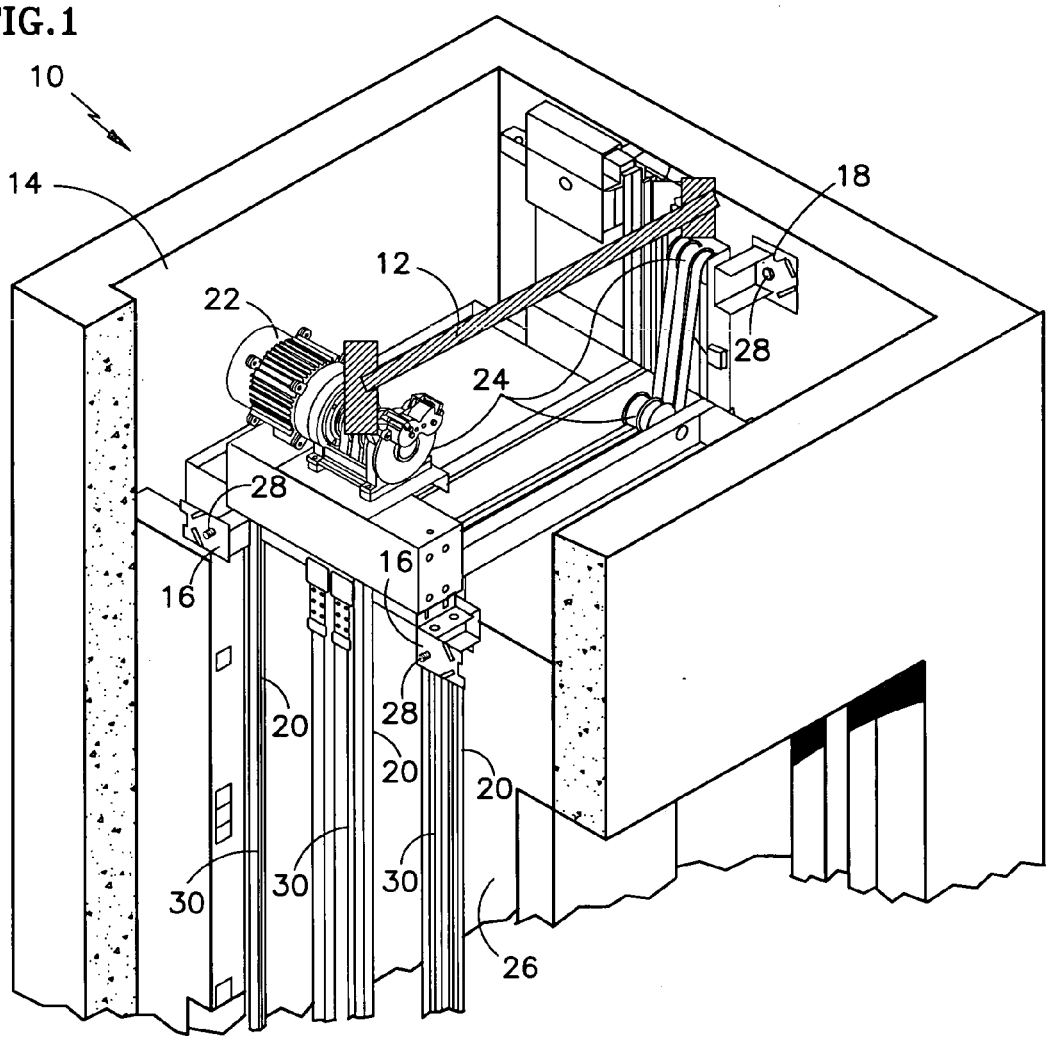
FIG. 1 is a partial, schematic view of an elevator system having a compression member according to a preferred embodiment of the present invention.

An elevator system (10) illustrating a horizontal compression member (12) according to the present invention is shown in FIG.1. The 35 elevator system (10) includes an elevator hoistway (14) having four walls, one of which is shown cut-away in FIG. 1. A set of elevator mounting brackets (16, 18) are provided as mounting means for mounting the elevator assembly components to the inside walls of the hoistway (14). The elevator assembly includes the elevator machine (22), various sheaves (24), the elevator car (26) suspended by ropes (30), and rails (20). Vertically aligned elevator rails (20) run along the inside hoistway walls and may be positioned to support some or most of the vertical load resulting from the elevator assembly. Bolts (28) are utilized to fix the brackets (16,18) to the inside hoistway walls. Under normal conditions, the bolts (28) are subject to tension loading, as the resultant vertical load of the elevator assembly is directed downwardly and is concentrated in the approximate center of the hoistway, thereby resulting in moment forces at the vertical support points at the inside hoistway walls. The tension loading is also transmitted from the bolts (28) through the brackets (16, 18) to the point at which the vertically-loaded elements are attached to the brackets (16, 18).

The compression member (12) according to the present invention is provided in such a manner so as to be compressed in between the vertical load bearing structures, such as the brackets (16, 18), elevator rails (20), or similar structures that suspend the vertical load. By spanning the horizontal distance between the brackets (16, 18) the compression member (12) counters the inwardly-directed tension loads in the bolts (28) that result from the moment caused by the elevator assembly vertical load.

The compression member (12) may be rigid as illustrated in FIG. 1. However, it will be clear to one skilled in the art that the compression member (12) may also be complaint. For example, a spring loaded telescoping beam, pre-loaded near or above the tension loads may also be used.

Figure 2:
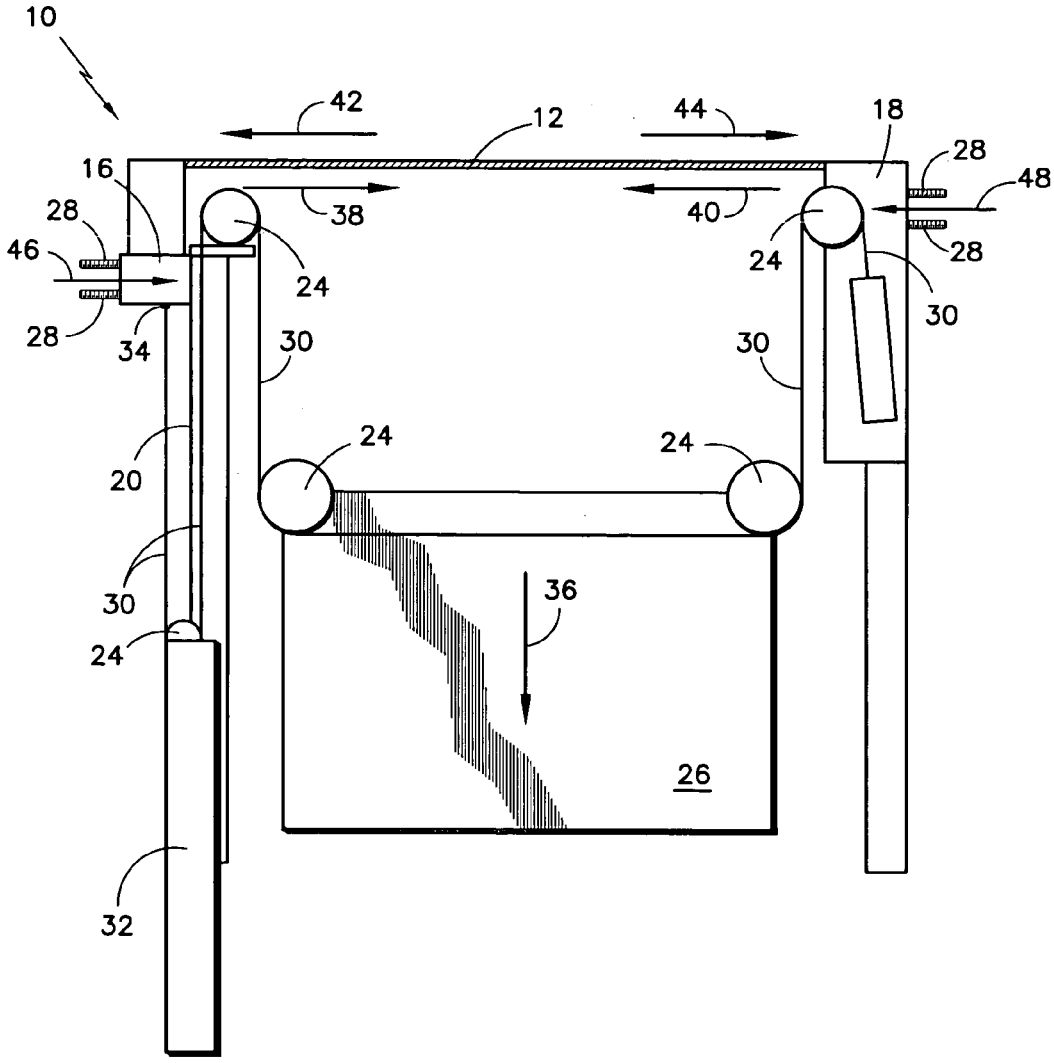
FIG. 2 is a partial, schematic side view of an elevator system according to FIG. 1.

Referring to FIG. 2, the compression member (12) is illustrated as spanning, in compression, the horizontal distance between the brackets (16, 18) which support rope hitch ends (34) and the counterweight (32) and the elevator car (26). The compression member (12) may similarly be positioned between elevator machine mounting hardware or other structures, such as the elevator rails (20). The resultant vertical load of the elevator system (10), represented by the vector arrow (36) causes resultant moment forces represented by the vector arrows (38, 40) that are countered by the compression forces (42, 44) of the compression member (12). The resultant tension forces (46, 48) transmitted through the bolts (28) are also countered by the compression forces (42, 44).

The compression member (12) may be made from any suitable material that provides sufficient compression strength and durability, such as structural steel.

It is possible to position one or more compression members of the type described herein according to the present invention in different locations from that specifically presented herein in the preferred embodiment, while effectively countering resultant tension and moment forces caused by vertical loads. For example, in machineroom-less elevator systems, the vertical loads of the elevator machine (22) and other equipment, e.g., controllers and dead end hitches for an elevator car, are often supported by brackets attached to the elevator guide rails (20). The guide rails (20) pass the vertical loads down through the building to the pit. In this configuration, there are minimal attachments to the walls, and the moment loads are concentrated on the guide rails (20). Therefore, in this exemplary embodiment, the optimal location for the horizontal compression member (12) is between the guide rails (20) themselves.

While the preferred embodiment of the present invention has been herein disclosed and described, modification and variation may be made without departing from the scope of the presently claimed invention.

What is claimed is:

1. An elevator system comprising:

an elevator assembly disposed within a hoistway and suspended by elevator ropes having ends suspended with respect to a pair of rigid structures affixed to opposing walls of the hoistway; and a compression member positioned between said rigid structures in such a manner so as to counter resultant forces applied to said rigid structures due to a vertical load.

2. An elevator system according to claim 1, wherein said resultant forces include moment forces and inwardly-directed, generally horizontal tension forces.

3. An elevator system according to claim 1, wherein said compression member is generally horizontally aligned.

4. An elevator system according to claim 1, further comprising mounting brackets for attaching said elevator assembly to said rigid structure.

5. An elevator system according to claim 4, wherein said compression member is positioned between said mounting brackets.

6. An elevator system according to claim 5, wherein said mounting brackets are positioned on opposite sides of said elevator assembly.

7. An elevator system according to claim 4, wherein said elevator rope ends are suspended by said mounting brackets.

8. An elevator system according to claim 1, wherein said compression member comprises a rigid compression member.

9. An elevator system according to claim 1, wherein said vertical load is attributable to said elevator assembly.

10. An elevator system according to claim 1, wherein said elevator assembly further comprises a pair of elevator guide rails having said compression member located therebetween.

11. A method of countering load reaction forces in a pair of rigid structures affixed to opposing walls of a hoistway caused by a vertical load attributable to an elevator assembly suspended from said rigid structures, said method comprising providing a compression member; and positioning said compression member between points on said rigid structures from which said elevator assembly is suspended.

12. A method according to claim 11, wherein said compression member is positioned generally horizontally.

13. A method according to claim 11, wherein said compression member is positioned between bracket structures that attach elevator rope ends to said rigid structure.

14. An elevator system comprising:

an elevator assembly disposed within a hoistway;

a pair of load bearing structures affixed to opposing walls within the hoistway and from which the elevator assembly is suspended by elevator ropes; and a compression member positioned between said load bearing structures in such a manner so as to counter non-vertical components of forces applied to said load bearing structures due to suspension of the elevator assembly.

15. The elevator system according to claim 14, wherein the load bearing structures comprise mounting brackets attached to walls of the hoistway.

16. The elevator system according to claim 15, wherein said mounting brackets are positioned on opposite walls of hoistway.

17. An elevator system comprising:

an elevator assembly disposed within a hoistway;

a pair of load bearing structures affixed to opposing walls within the hoistway and from which the elevator assembly is suspended; and a compression member positioned between said load bearing structures in such a manner so as to counter non-vertical components of forces applied to said load bearing structures due to suspension of the elevator assembly.

18. The elevator system according to claim 17, wherein the load bearing structures comprise mounting brackets for attaching said elevator assembly to walls of the hoistway.

19. The elevator system according to claim 18, wherein said mounting brackets are positioned on opposite walls of hoistway.

20. The elevator system according to claim 18, wherein the elevator assembly comprises an elevator car and elevator ropes by which the car is suspended, and ends of the elevator ropes are suspended by the mounting brackets.

* * * * *

UNITED STATES PATENT AND TRADEMARK OFFICE

CERTIFICATE OF CORRECTION

PATENT NO. : 7,150,342 B2
APPLICATION NO. : 09/497359
DATED : December 19, 2006
INVENTOR(S) : Adifon et al.

It is certified that error appears in the above-identified patent and that said Letters Patent is hereby corrected as shown below:

On the cover page, at (54): Title

"ELEVATOR STRUCTURE MOUNTING SYSTEM HAVING HORIZONTAL MEMBER FOR REDUCING BUILDING LOADS AT TOP OF HOISTWAY" should read -- ELEVATOR STRUCTURE MOUNTING SYSTEM HAVING HORIZONTAL COMPRESSION MEMBER FOR REDUCING BUILDING LOADS AT TOP OF HOISTWAY --.

Signed and Sealed this

Twenty-seventh Day of March, 2007

JON W. DUDAS
*Director of the United States Patent and Trademark Office*